US010378809B2

(12) United States Patent
Laible

(10) Patent No.: US 10,378,809 B2
(45) Date of Patent: Aug. 13, 2019

(54) DOMESTIC REFRIGERATION APPLIANCE WITH A COOLING COMPARTMENT AND A DOOR CLOSING THE COOLING COMPARTMENT, THE ROTATION AXIS OF WHICH IS DISPLACEABLE IN THE WIDTH DIRECTION

(71) Applicant: BSH HAUSGERAETE GMBH, Munich (DE)

(72) Inventor: Karl-Friedrich Laible, Langenau (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/672,354

(22) Filed: Aug. 9, 2017

(65) Prior Publication Data

US 2018/0045449 A1 Feb. 15, 2018

(30) Foreign Application Priority Data

Aug. 10, 2016 (DE) ..... 10 2016 214 833

(51) Int. Cl.
*F25C 5/20* (2018.01)
*E05D 3/04* (2006.01)
(Continued)

(52) U.S. Cl.
CPC ..... *F25C 5/22* (2018.01); *E05D 3/04* (2013.01); *E05D 3/06* (2013.01); *E05D 3/16* (2013.01); *E05D 7/02* (2013.01); *E05D 7/04* (2013.01); *F25D 23/126* (2013.01); *E05D 2007/0461* (2013.01); *E05Y 2800/10* (2013.01); *E05Y 2900/13* (2013.01); *E05Y 2900/306* (2013.01); *E05Y 2900/31* (2013.01);
(Continued)

(58) Field of Classification Search
CPC ..... F25C 5/22; F25C 2300/00; E05D 7/02; E05D 3/16; E05D 5/046; E05D 7/04; E05D 2007/0461; F25D 23/028; F25D 23/02; E05Y 2900/13; E05Y 2800/10; E05Y 2900/31; E05Y 2900/306
See application file for complete search history.

(56) References Cited

U.S. PATENT DOCUMENTS

2008/0196430 A1* 8/2008 McGill ..... F16K 7/045 62/228.1
2010/0218540 A1* 9/2010 McCollough ..... F25C 5/22 62/340

(Continued)

*Primary Examiner* — Emmanuel E Duke
(74) *Attorney, Agent, or Firm* — Laurence A. Greenberg; Werner H. Stemer; Ralph E. Locher

(57) ABSTRACT

A domestic refrigeration appliance having a housing in which a cooling compartment is provided, and is closable by a first door which is movably arranged on the housing. The appliance further having a dispensing unit having an output unit and an ice maker. The dispensing unit is configured for the output of liquid and/or molded ice elements and is arranged on the first door. A rear side of the first door facing toward the cooling compartment has a receptacle protruding toward the cooling compartment, in which receptacle the dispensing unit is arranged. The first door is pivotably arranged with at least one multiple-joint hinge on the housing. The multiple-joint hinge has a mechanism with which, during the pivoting movement of the first door, the first door is also displaced in the width direction.

18 Claims, 4 Drawing Sheets

(51) Int. Cl.

| | |
|---|---|
| ***E05D 7/02*** | (2006.01) |
| ***E05D 7/04*** | (2006.01) |
| ***E05D 3/06*** | (2006.01) |
| ***E05D 3/16*** | (2006.01) |
| ***F25D 23/12*** | (2006.01) |

(52) U.S. Cl.
CPC .... *F25C 2300/00* (2013.01); *F25D 2323/021* (2013.01); *F25D 2323/024* (2013.01)

(56) References Cited

U.S. PATENT DOCUMENTS

| | | | | |
|---|---|---|---|---|
| 2010/0231111 | A1* | 9/2010 | Kang | E05D 3/022 312/405 |
| 2010/0287971 | A1* | 11/2010 | Lee | F25D 23/126 62/347 |
| 2010/0326096 | A1* | 12/2010 | Junge | F25D 17/065 62/82 |
| 2011/0023525 | A1* | 2/2011 | Eckartsberg | F25D 23/126 62/391 |
| 2014/0311173 | A1* | 10/2014 | Nilles | A47F 3/043 62/256 |

* cited by examiner

DOMESTIC REFRIGERATION APPLIANCE WITH A COOLING COMPARTMENT AND A DOOR CLOSING THE COOLING COMPARTMENT, THE ROTATION AXIS OF WHICH IS DISPLACEABLE IN THE WIDTH DIRECTION

CROSS-REFERENCE TO RELATED APPLICATION

This application claims the priority, under 35 U.S.C. § 119, of German application DE 10 2016 214 833.8, filed Aug. 10, 2016; the prior application is herewith incorporated by reference in its entirety.

BACKGROUND OF THE INVENTION

Field of the Invention

The invention relates to a domestic refrigeration appliance with a housing in which a cooling compartment is provided, which is closable by a first door movably arranged on the housing. The domestic refrigeration appliance further contains a dispensing unit which is configured for the output of liquid and/or molded ice elements, the dispensing unit having an output unit and an ice maker. The dispensing unit is arranged on the first door. Provided on a rear side of the first door facing toward the cooling compartment is a receptacle protruding toward the cooling compartment, in which the dispensing unit is arranged.

Domestic refrigeration appliances are known in which receptacle compartments for food are provided and which are configured, firstly, as a cooling compartment and, secondly, as a freezing compartment. The food can thus be stored at different temperatures.

Precisely when domestic refrigeration appliances are also to be arranged in a furniture wall and in that context are also to be usable as built-in appliances, the functionality is possibly also restricted since a door can then be covered over, if needed, by an additional part, in particular, in the form of a furniture front panel.

It is also known that domestic refrigeration appliances can contain a dispensing unit which is configured for the output of liquid and/or molded ice elements. In this context, devices are known in which the output unit of the dispensing unit is arranged in a door, whereas the ice maker is arranged externally in a receptacle chamber of the domestic refrigeration appliance and can also be arranged in a cooling compartment.

Furthermore, embodiments are known in which the overall dispensing unit is arranged with its output unit and with the ice maker internally in the door. In these embodiments, however, the rear-side space requirement of the door and thus the space requirement of the region facing the cooling compartment in the closed state of the door is relatively large. Such a rearward protrusion leads in conventional devices thereto that, in the open state of the door, this protrusion is undesirably in the way with regard to accessibility to the cooling compartment.

SUMMARY OF THE INVENTION

It is an object of the present invention to provide a domestic refrigeration appliance in which a dispensing unit for the output of liquid and/or molded ice elements is arranged in the door and, in the open state of the door, the access to the cooling compartment, which is closable by the door, is improved.

A further independent aspect of the invention relates to a domestic refrigeration appliance with a housing in which a cooling compartment is provided, which is closable by a first door movably arranged on the housing. The domestic refrigeration appliance further contains an output unit and an ice maker which are components of a dispensing unit. The dispensing unit is configured for the output of liquid and/or molded ice elements. The overall dispensing unit and thus the output unit and the ice maker are arranged on the first door and are therefore arranged internally in the door. A rear side of the first door facing toward the cooling compartment has a receptacle which is oriented protruding toward the cooling compartment, and in which the dispensing unit is arranged. A significant concept of this further independent aspect of the invention is to be found therein that the first door is pivotably arranged on the housing with at least one multiple-joint hinge, in particular at least two multiple-joint hinges, wherein the multiple-joint hinge has a mechanism with which during the pivoting movement of the first door, this first door, in particular also a rotation axis of the first door, is displaceable or is displaced in the width direction of the domestic refrigeration appliance. Thus, particularly in embodiments of the domestic refrigeration appliance wherein the entire dispensing unit is arranged internally in the door and wherein therefore an enlarged structure is arranged in the depth direction on the rear side of the door in comparison with embodiments in which the ice maker is not arranged in the door but in the cooling compartment itself, it is nevertheless achieved that the access to the cooling compartment with the first door open is improved.

In such embodiments, the output unit and the ice maker are thus arranged in this first door itself and are therefore positioned completely internally in the door. The entire dispensing unit is therefore spatially fixed to the door and is moved therewith. In an embodiment of this type, additional components for connecting the ice maker and the output unit, as in the embodiment described above in which the ice maker is arranged in the cooling compartment, are therefore not required. Interfaces between the ice maker and the output unit which with permanent coupling and uncoupling must nevertheless be configured lastingly sealing and enabling a continuous transfer are also not required in this completely integrated embodiment of the dispensing unit in the first door.

In a particularly advantageous manner, it is provided that the multiple-joint hinge is an at least 4-joint hinge and the mechanism has at least four pivot points.

It is provided in particular that the multiple-joint hinge is an at least 7-joint hinge and that the mechanism has seven pivot points. In complex multiple-joint hinges of this type, the individual joint arms can very advantageously be so coupled that during the movement sequence and thus during the pivoting movement of the door, minimal structural space is required and the linear displacement of the rotation axis in the width direction is nevertheless also precisely achieved. Since particularly with such complex movement sequences which, beside the pivoting movement also effectively enable a linear movement, at least vectorially considered, and thus enable a displacement of the rotation axis, in addition, particularly in domestic refrigeration appliances with such relatively heavy doors, the mechanical robustness is an essential aspect. This is enabled, in particular, with such many-jointed hinges, wherein particularly when the hinge is intrinsically mechanically stable and robust and enables the complex movement sequences, even of the individual hinge arms relative to one another precisely and lastingly. This is fulfilled to a particular degree especially in a multiple-joint hinge which is a 7-joint hinge.

It is provided in a particularly advantageous manner that the mechanism of the multiple-joint hinge is configured such that in particular, the complete displacement of the rotation axis in the width direction takes place only in a pre-determined angular interval of the overall pivot movement of the first door. The mechanism that is formed by the number of hinge arms is particularly preferably provided in this embodiment in such a way, and the hinge arms are coupled such that effectively on a first movement component wherein the door is opened from a closed position, therefore only one pivot movement takes place about the then still fixed rotation axis and only during a further movement component which is then defined by the pre-determined angular interval along the pivot movement from an achieved opening angle of the door, in addition to the pivoting and therefore rotary movement, a linear movement takes place in which the local displacement of the rotation axis takes place. With such an embodiment in which this displacement of the rotation axis in the width direction takes place over a partial interval of the whole movement travel during the pivoting movement of the first door, the complexity of the structure of the multiple-joint hinge can be reduced.

It is provided, in particular, that this angular interval lies between 85° and 120°, particularly between 90° and 115°, of the entire angular interval over which the door can move, wherein this angular interval is dimensioned, starting from the closed position in which the door is arranged at 0°, and thus the lower interval limit gives the opening angle from which, along the further opening route, the linear displacement then also takes place. The displacement of this rotation axis in the width direction thus takes place only with a relatively widely opened door and over a relatively small angular interval compared with the overall movement possibility and therefore relative to the whole angular interval over which the door can move. This is also advantageous in that the movement process of the door taking place up to this angular interval does not change or is not impaired and only when the door is relatively wide open and is practically oriented essentially with its front side in the depth direction, then a further displacement takes place outwardly, so that here particularly in this angular interval and starting from the then already achieved position of the door, the lateral displacement predominates as compared with the further rotary movement.

It is provided, in particular, that the cooling compartment is closable by the first door and by a third door arranged, seen in the width direction of the domestic refrigeration appliance, beside the first door. In an advantageous embodiment of this type, therefore, two doors are provided which are configured as leaf doors with which the cooling compartment is closable. By this means, the cooling compartment can be configured larger or, on the other hand, for the accessibility of the cooling compartment, the opening of both doors must not necessarily take place, rather just one door can be opened, so that an escape of refrigeration energy is reduced and thus a more energy-efficient operation is possible. Furthermore, not only a single very large door must be provided for closing the cooling compartment, which would be heavy to actuate and also would also need significantly larger dimensioned hinges.

In particular, it is provided that the first additional part is a furniture front panel. With this embodiment, the front covering of the domestic refrigeration appliance can be particularly advantageously adapted to the surroundings of the installation niche in which the domestic refrigeration appliance can be installed. In the closed state of the first door, the domestic refrigeration appliance is then effectively no longer recognizable as such in the region of the first door, but is covered by the furniture front panel. A tidy and calm front-side visual appearance of the furniture wall is thereby achieved.

In particular, it is preferably provided that at a front side of the second door, a second additional part separate from the second door is arranged as a facing or covering part. The advantages achievable in this regard have already been set out above in the description of the first additional part on the first door.

Here also, it can be provided that the second additional part is a furniture front panel.

In particular, it is provided that the domestic refrigeration appliance has an adjusting device with which at least the output unit of the dispensing unit is adjustable relative to the first door and/or relative to the first additional part in at least two spatial directions. This is a further very advantageous embodiment since effectively a plurality of separate components is provided which must be built in exactly positioned to one another. This concerns firstly the first door, secondly the first additional part and further additionally, at least the output unit. Since, due to manufacturing tolerances and other tolerances, positional inaccuracies can arise, these can be counteracted by the adjusting device.

In particular, it is provided that the adjusting device is also configured to adjust the additional part relative to the door and/or relative to the output unit and also this is enabled particularly in at least two spatial directions. In this context, it can be achieved in a particularly advantageous manner that firstly, at least, one of the two components, specifically for example, the output unit or the additional part is in the foreground and, in this regard, firstly, an orientation to one of the two other components takes place. Once this has taken place, by means of the adjusting device, the other component, specifically the output unit or the additional part can then be adjusted, so that the interplay of these specified three components with regard to the respective individual desired position of at least one of the other components can be achieved as well as possible.

It is preferably provided that the adjusting device has at least one displaceable adjusting element which is asymmetrical in shape and which is arranged in a niche offset forwardly in the depth direction of the domestic refrigeration appliance relative to a rear back wall region of a housing of the output unit, the niche being delimited by a further back wall region of the housing arranged further forward. This is a very advantageous embodiment, since thus precisely when the whole dispensing unit is built into the first door, the space requirement in the depth direction must be kept as small as possible rearwardly. In this protruding receptacle on the rear side of the first door on which the whole dispensing unit is also installed, in particular, additional thermal insulating material is also provided by means of which a sufficient thermal insulation effect is to be achieved in the closed state of the door to the cooling compartment. Since the thermal insulating material is to be configured with a certain thickness in the depth direction in order to be able also to achieve an energy-efficient insulating effect, a certain build-up here in the depth direction is unavoidable. If this adjusting element were to adjoin the rear back wall region of the housing, seen in the depth direction, additional structural space would be required here, which would again enlarge the protruding receptacle on the rear side of the door. In that with the advantageous embodiment of the invention, such a niche region is now explicitly provided in the design of the back wall region of the housing, this structural space extension in the depth direction is no longer required. The niche can accommodate this adjusting element and, in particular, the adjusting element then no longer protrudes rearwardly, seen in the depth direction, beyond this rear back wall region so that the component part lying furthest rearward in the depth direction is already formed by the rear back wall region and adjoining this in the depth direction, the thermal insulating material can again be introduced at the desired thickness.

It is preferably provided that the adjusting element is a wedge. With an embodiment of this type, a particularly precise and finely adjusted and also continuous position setting can take place.

It is preferably provided that the domestic refrigeration appliance has a water-conducting assembly with which water, in particular from a water network externally to the appliance is conductable to the dispensing unit. The water-conducting assembly has at least one valve which is arranged on the first door or on the second door. The supply of the water to the output unit and/or to the ice maker is dosed with the valve. With such an embodiment, access to the valve is improved and a position is also provided in which freezing-up of the valve is prevented. The position of the at least one valve in this regard is also advantageous particularly in the embodiments in which the overall dispensing unit is arranged in the door. Since therefore both conduits, of which one leads to the output unit and the other to the ice maker, are then also laid as extensively as possible in the door itself, the mounting of the at least one valve, particularly two valves if the supply of water is provided, firstly, to the output unit for the output of a liquid and, secondly, to supply the ice maker to generate molded ice elements, is advantageous. In this regard, short conduit routes can also be realized with as few interfaces as possible. A possible leakage problem is also thereby minimized.

It is provided, in particular, that further components of the water-conducting assembly are arranged in a machine space of the domestic refrigeration appliance, wherein the machine space is situated, in particular, in a lower rear region of the housing. In order to conduct the water from the machine space to the dispensing unit, conduits are also laid which extend through a hinge with which the first door is pivotably arranged on the housing, and then are further laid in the door. A particularly special advantage is to be seen therein that with an embodiment in which both the output unit and also the dispensing unit are arranged in the door and in that respect, therefore, two separate valves are also required, only a single feed conduit from the machine space via the door hinge to the two valves on the door is required, since the further distribution via two separate conduits from the respective valves, firstly, to the output unit and, secondly, to the ice maker is already provided in the door itself. By this means, the difficult interface for carrying out a water-conducting connection from outside the door via the hinge to the door can also be improved, since now only a single conduit must be fed through this hinge.

In particular, it is provided that the at least one valve is arranged at a lower region of a door and is covered by the additional part on the front side of the door. With this embodiment, the valve is also arranged protected but nevertheless easily accessible. Furthermore, with this exposed mounting on the lower edge of the door, the valve is not in the way of other components and in this regard also then does not restrict access to the cooling compartment or the freezing compartment.

In particular, the valve is arranged on a lower edge of the first door which closes the cooling compartment.

A further independent aspect of the invention relates to a domestic refrigeration appliance which contains a housing in which a cooling compartment is provided. The cooling compartment is closable by a first door movably arranged on the housing. The domestic refrigeration appliance contains a freezing compartment which is separate from the cooling compartment and is closable by a second door movably arranged on the housing. The two doors are separate doors which can be actuated independently of one another. In particular, the doors are closing parts of the domestic refrigeration appliance at the front side. The two doors are arranged, in particular, adjoining one another and/or extending in a same plane and without overlap in this plane. An important concept of the invention is to be found therein that on a front side of the first door, a first additional part separate from the first door is arranged as a facing or covering part and a perforation and a hole is formed in this additional part, through which an output unit of a dispensing unit belonging to the domestic refrigeration appliance which is configured for the output of liquid and/or molded ice elements is accessible. By means of such an embodiment, a highly functional domestic refrigeration appliance can be provided which in two different compartments, specifically the cooling compartment and the freezing compartment, can store food under different conditions, in particular, different temperatures. Furthermore, the domestic refrigeration appliance is entirely suitable as a built-in appliance and can therefore be built into an installation niche of a furniture wall. By means of the additional part, a covering is provided on the front side which is adaptable, in particular, to the environment of the furniture wall. Furthermore, it is also possible with a domestic refrigeration appliance of this type, to provide a dispensing unit which is then readily accessible through the additional part.

A further independent aspect of the invention relates to a domestic refrigeration appliance with a housing in which a cooling compartment is provided, which is closable by a first door movably arranged on the housing. The domestic refrigeration appliance further contains a dispensing unit which is configured for the output of liquid and/or molded ice elements. The dispensing unit contains an output unit and an ice maker wherein both the output unit and also the ice maker are arranged on the first door itself and are therefore arranged internally in the door. Furthermore, the domestic refrigeration appliance contains a water-conducting assembly with which water is conductable to the dispensing unit. The water-conducting assembly has at least one valve which is configured, in particular, to pass the water which is fed to the water-conducting assembly, in particular, externally to the appliance, in dosed manner to the output unit and/or the ice maker. This at least one valve is arranged on the first door itself and thus represents a component internal to the door. In particular, it is provided that the water-conducting assembly has two separate valves wherein by one valve, the conduit route to the output unit and by the other valve, the conduit route to the ice maker is provided. Further components of the water-conducting assembly are arranged, in particular, in a machine space of the domestic refrigeration appliance. Between these further components of the water-conducting assembly in the machine space and the at least one valve, a feed conduit is provided which is laid via a hinge with which the first door is pivotably arranged on the housing of the domestic refrigeration appliance. Even if two valves are provided, arranged internally to the first door, only a single such common feed conduit is laid from the machine space via the hinge of the door to the two valves. A separate connecting conduit is then laid from each of the two valves between the valve and the output unit, on one side, and the other valve and the ice maker.

Advantageous embodiments of one independent aspect of the invention are to be regarded as advantageous embodiments of a further independent aspect of the invention.

The stipulations "above", "below", "in front", "behind", "horizontal", "vertical", "depth direction", "width direction", "height direction", etc., indicate positions and orientations on proper use and proper arrangement of the appliance and with an observer positioned in front of the device and looking in the direction of the device.

Further features and embodiments of the invention are disclosed in the claims, the drawings and the description of the drawings. The features and combinations of features mentioned in the description above and the following features and combinations of features in the description of the drawings and/or shown in the drawings alone are usable not only in the respective combination given, but also in other combinations without departing from the scope of the invention. Embodiments of the invention which are not explicitly shown in the figures and described, but which arise and can be created through separate combinations of features from the embodiments described can therefore also be considered to be included and disclosed. Embodiments and combinations of features can also be regarded as disclosed which therefore do not have all the features of an originally formulated independent claim. Furthermore, embodiments and combinations of features are to be regarded as disclosed, in particular by the embodiments disclosed above which go beyond or deviate from the combinations of features represented by the references in the claims.

Other features which are considered as characteristic for the invention are set forth in the appended claims.

Although the invention is illustrated and described herein as embodied in a domestic refrigeration appliance with a cooling compartment and a door closing the cooling compartment, the rotation axis of which is displaceable in the width direction, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 4 is an enlarged, simplified schematic representation of a door of the domestic refrigeration appliance, where valves of a water-conducting assembly are built in;

DETAILED DESCRIPTION OF THE INVENTION

Figure 1:
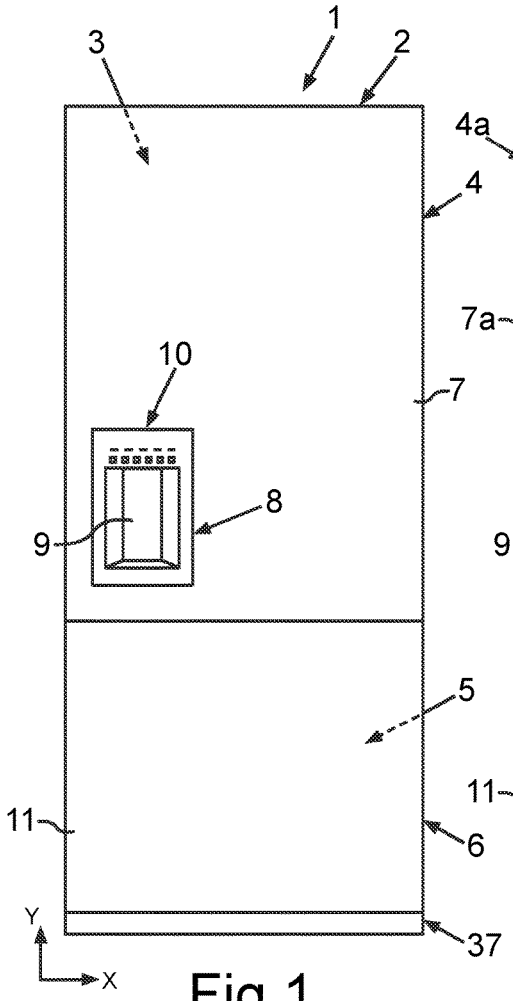
FIG. 1 is a diagrammatic, front view of a first exemplary embodiment of an inventive domestic refrigeration appliance.

In the figures, the same or functionally identical elements are provided with the same reference characters.

Referring now to the figures of the drawings in detail and first, particularly to FIG. 1 thereof, there is shown an exemplary embodiment of a domestic refrigeration appliance 1 in a front view, which has a housing 2 in which a cooling compartment 3 is arranged which is closable at the front by a first door 4. The domestic refrigeration appliance 1 also contains a freezing compartment 5 separate from the cooling compartment 3, which is closable by a second door 6. The doors 4 and 6 represent front external parts which in the movement with which the doors 4 and 6 spread out, are arranged mutually parallel and overlap-free.

It is also provided that the cooling compartment 3 is closable by the one door 4. The domestic refrigeration appliance 1 further contains a front-side panel-shaped additional part which is configured, in particular, as a furniture front panel and which is arranged on a front side of the door 4 and is configured covering it over the extent of the surface. The additional part 7 covers the front surface of the door 4 practically completely and has only one hole 8 through which a niche 9 of a dispensing unit 10 is accessible. The dispensing unit 10 is configured for the output of liquid and/or molded ice elements and is a component of the domestic refrigeration appliance 1.

Additionally, a further furniture front panel is provided as an additional part 11 which is arranged on the front side of the door 6 and covers this front side or front surface entirely. The two additional parts 7 and 11 are separate components.

Figure 2:
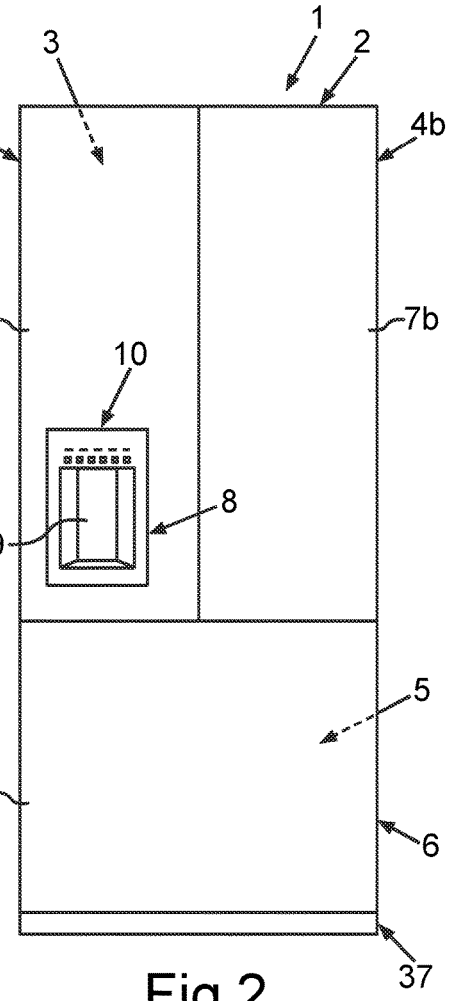
FIG. 2 is a front view of a further exemplary embodiment of an inventive domestic refrigeration appliance.

FIG. 2 shows a front view of a further exemplary embodiment of a domestic refrigeration appliance 1 in which, as distinct from the embodiment of FIG. 1, the cooling compartment 3 is closable by two separate doors 4*a* and 4*b*, each of which is pivotable about a pivot axis or rotation axis oriented in the height direction (y-direction). In this exemplary embodiment, it is provided that a plate-like additional part 7*a* covers the door 4*a* on the front side and a plate-like additional part 7*b* covers the door 4*b* on the front side. The additional part 7*a* is arranged on a front side 41*a* of the door 4*a* and the additional part 7*b* is arranged on a front side 41*b* of the door 4*b*.

The domestic refrigeration appliances 1 are configured, in particular, as built-in appliances and can thus be arranged in an installation niche of a furniture wall. A built-in appliance is also characterized, in particular and as is generally the case, in that it has a fastening device for a separate covering part such as a furniture front panel and/or fastening device for fastening the domestic refrigeration appliance to delimiting walls of an installation niche and/or side walls and/or a roof wall of the housing 2 are formed as panels made of paperboard. A proper arrangement of the built-in appliance requires, in particular, installation in an installation niche.

Figure 3:
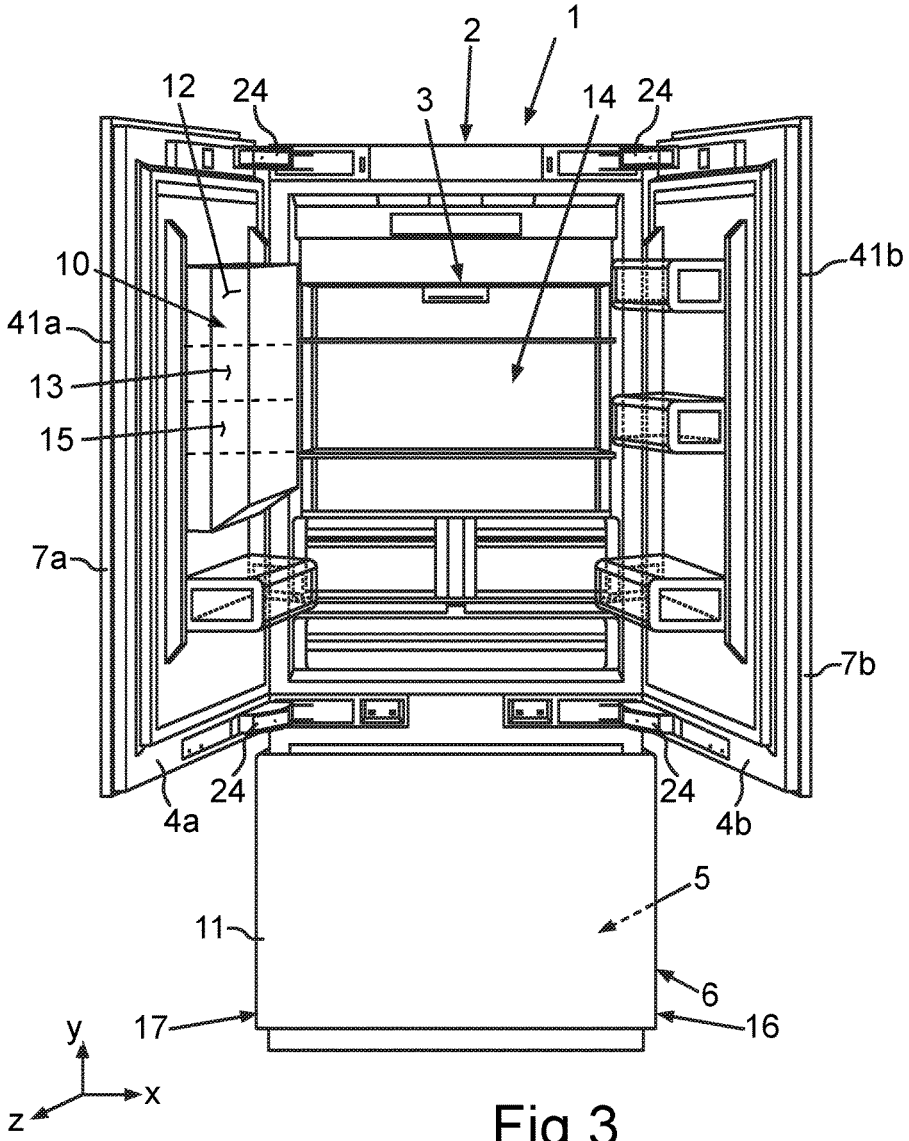
FIG. 3 is a front view of the domestic refrigeration appliance of FIG. 2 with opened doors, which are configured for closing a cooling compartment.

FIG. 3 shows the exemplary embodiment of the domestic refrigeration appliance 1 of FIG. 2 in an embodiment in which the dispensing unit 10 is arranged with an associated ice maker 12, not in the cooling compartment 3, but directly on the door 4*a*. The ice maker 12 contains a receptacle container 13 which is configured for receiving molded ice elements that are generated by the ice maker 12.

The dispensing unit 10 also contains an output unit 15 which is also provided in the door 4*a*. By means of the output unit 15, the liquid and/or molded ice elements can be output into the niche 9 in which a receiving vessel can be placed.

Figure 4:
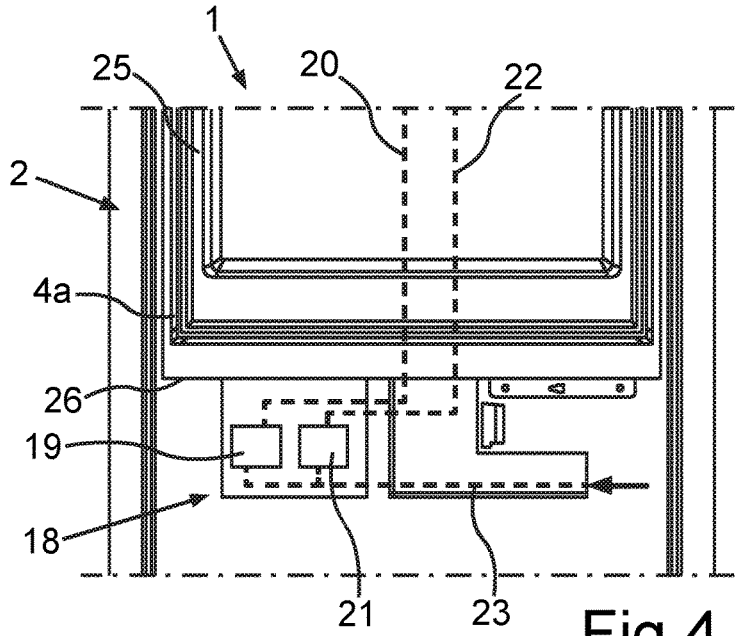

The domestic refrigeration appliance 1, as described in the exemplary embodiments above, contains in a rear lower region 16, a machine space 17 in which a water-conducting assembly 18 (FIG. 4) is arranged. The water-conducting assembly 18 is responsible for passing water which is fed in externally to the appliance, for example, via a domestic water network, to the domestic refrigeration appliance 1, on to the dispensing unit 10. For this purpose, it is provided that components of this water-conducting assembly 18 are arranged externally to this machine space 17. In particular, it is provided here that a first valve 19 is arranged externally to the machine space 17, wherein this first valve 19 which belongs to the water-conducting assembly 18 is arranged on a door, in particular, the door 4*a*, as shown in FIG. 4 in this exemplary embodiment. In the embodiment of FIG. 1, this valve 19 would be arranged on the door 4.

By means of the first valve 19, water is conducted, in particular, to the output unit 15 in order to be able to output the relevant liquid there, for example as a drink or a mixed drink. For this purpose, a dedicated conduit 20 is provided which extends between the valve 19 and the output unit 15.

Particularly when the dispensing unit 10 is also configured for the output of molded ice elements and has the ice maker 12, a second valve 21 is provided which in the exemplary embodiment is preferably also arranged on the door 4*a*, in particular if the ice maker 12 is also arranged in the door 4*a*. It is provided, by means of a dedicated conduit 22 between the second valve 21 and the ice maker 12, that the relevant water supply takes place in a dosed manner.

It is advantageous in an embodiment of this type that a conduit 23 which extends between the components of the water-conducting assembly 18 in the machine space 17 and the valves 19 and 21 arranged on the door 4*a* is configured merely as a single feed conduit. This conduit 23 is laid from the machine space 17 via a hinge 24 (FIG. 3) to the valves 19 and 21. Due to the arrangement of both valves 19 and 21 in the door 4*a*, it is also not necessary to lay two separate conduits from the machine space 17 to the door 4*a*, so that space is saved specifically in the region of the passage at the hinge 24.

FIG. 4 shows a schematic representation in a partial portion with a view toward the door 4*a* seen from inside and thus toward a rear side 25 of the door 4*a*. It is provided in particular that at least one valve 19 and/or 21 is arranged on a lower edge 26 of the door 4*a*.

In the embodiment of FIG. 4, it is advantageously provided that the valves 19 and 21, in a front view of the domestic refrigeration appliance 1 and with the door 4, 4*a* closed, are hidden by the additional parts 7, 7*a*.

Figure 5:
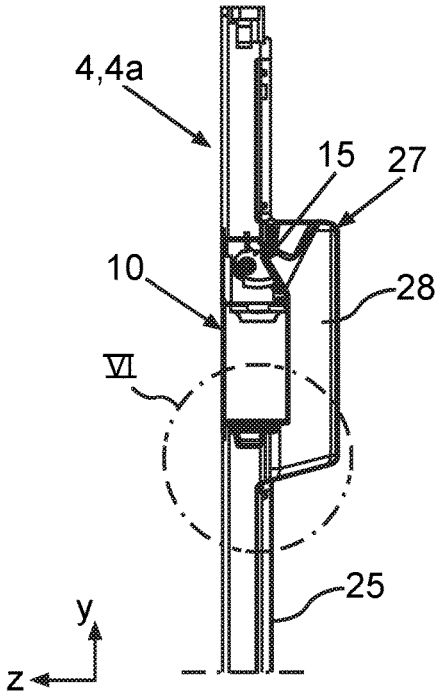
FIG. 5 is a vertical sectional view through a subregion of a door for closing the cooling compartment of the domestic refrigeration appliance.

In FIG. 5, in a vertical sectional representation, a partial portion of the door 4 or also the door 4*a* is shown. The embodiment and the description apply for both exemplary embodiments of the domestic refrigeration appliance according to FIG. 1, as well as for the exemplary embodiments of FIGS. 2 and 3.

As shown here, the dispensing unit 10 extends at least with the output unit 15 and preferably also with the ice maker 12 in the door 4, 4*a*. By this means, there results a protruding receptacle 27 locally on the rear side 25, in which the dispensing unit 10 is arranged. Due to a required thermal insulating effect of the door 4, 4*a*, a suitable structure in the depth direction (z-direction) is needed and thermal insulating material 28 is required between the components of the dispensing unit 10 and a rearward delimiting wall region of the rear side 25. Precisely when, but not only when, the dispensing unit 10 is arranged both with the output unit 15 and also the ice maker 12 in the door 4, 4*a*, there therefore results a corresponding build-up in the depth direction.

Figure 6:
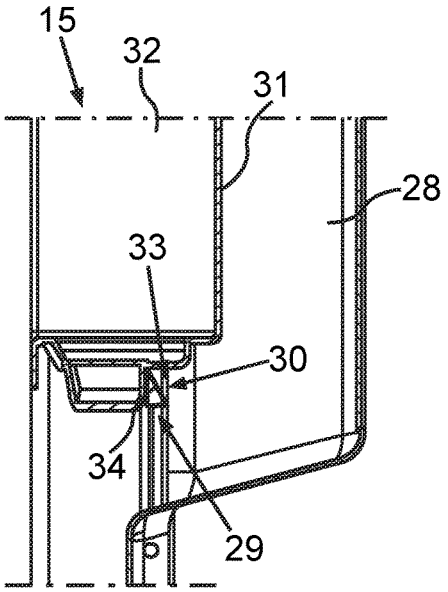
FIG. 6 is an enlarged representation of a subregion of FIG. 5.

The domestic refrigeration appliance 1 contains, in particular, an adjusting device 29 as shown symbolically in the enlarged illustration in FIG. 6 showing the extract VI in FIG. 5. The adjusting device 29 is configured such that the dispensing unit 10 in the door 4, 4*a* is adjustable in at least two spatial directions relative to the furniture front panel (not shown in FIGS. 5 and 6), which is configured in the form of the additional part 7, 7*a*. Furthermore, the adjusting device 29 is, in particular, also configured such that the dispensing unit 10 in the door 4, 4*a* is adjustable not only in at least these two spatial directions relative to the door 4, 4*a*, but in addition or instead, is also adjustable relative to this additional part 7, 7*a* in at least two spatial directions. In particular it is provided that this adjusting device 29 is also configured for adjusting the additional part 7, 7*a* relative to the door 4, 4*a*, so that here, in each case, a plurality of the three mentioned components, specifically the door 4, 4*a*, the additional part 7, 7*a* and the dispensing unit 10 can be aligned relative to one another. By this means, a highly precise and extremely positionally accurate arrangement of these three components to one another can be enabled. By this means, individual and finely adjusted positional displacements of the respectively mentioned components relative to one another, at least in pairs, are possible.

In particular, the adjusting device 29 contains at least one adjusting element 30, preferably a plurality of such adjusting elements 30, as shown symbolically in FIG. 6. The adjusting element 30 is displaceably arranged and is configured asymmetrically in form. In particular, the adjusting element 30 is configured as a wedge. In a particularly advantageous manner, it is provided that this adjusting element 30 is arranged offset in the depth direction and thus in the z-direction of the domestic refrigeration appliance 1 relative to a rear back wall region 31 of a housing 32 of the output unit 15 or the housing of the dispensing unit 10 seen in the depth direction, toward the front, and thus in a positive z-direction relative to this rear back wall region 31. In particular, the housing 32 contains a niche 33 for this purpose, which is delimited by a further back wall region 34 arranged further forward in the positive z-direction. The further back wall region 34 is therefore offset forwardly as compared with the rearmost or rear back wall region 31, so that this niche 33 is created in the lower region of the housing 32. This is a very advantageous embodiment since thereby no additional structure is required in the depth direction, which otherwise would be provided if the adjusting device 29, in particular the adjusting element 30 were arranged adjoining the rear back wall region 31 toward the rear and were to engage with this rear back wall region 31 for position adjustment. By means of this niche 33 as provided, the rearward structure with the insulating material 28 is therefore not to be enlarged again and in this region of the niche 33, there is already in effect a sufficient material thickness of the insulating material 28 present.

It can be provided that the adjusting device 29 contains at least two such adjusting elements 30 which are arranged at different sites and enable a very continuous and finely adjusted position displacement in at least two spatial directions. The adjusting device 29 can be configured, in particular, as a purely mechanical adjusting device.

Figure 7:
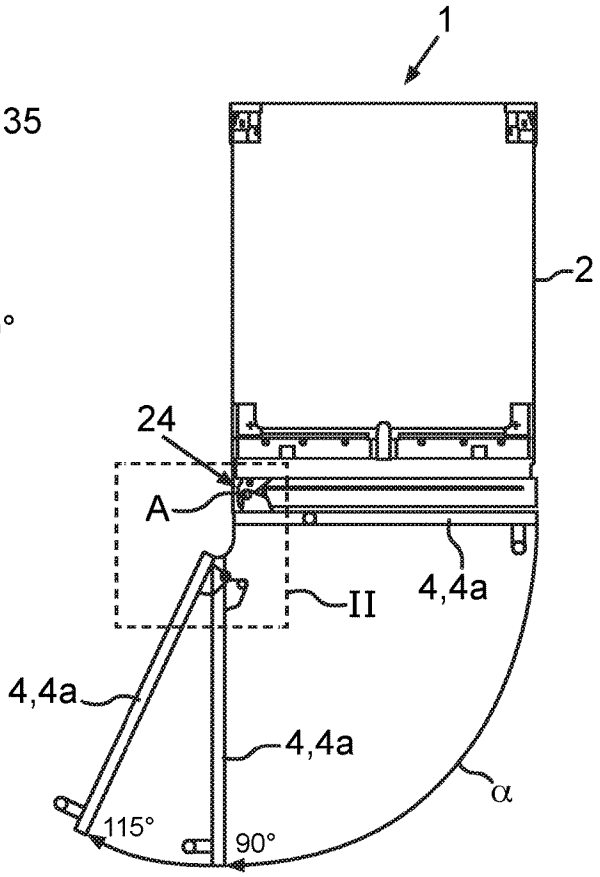
FIG. 7 is a plan view of an exemplary embodiment of the domestic refrigeration appliance, in which different positions of the door are shown.

FIG. 7 shows a plan view of the domestic refrigeration appliance 1. The door 4, 4*a* is shown, firstly, in the closed state. For the sake of clarity, the additional part 7 is not shown in FIG. 7.

As indicated above, the door 4, 4*a* is arranged pivotable on the housing 2 by means, in particular, of two hinges 24. For this purpose, a vertical rotation axis A is provided which therefore extends in the height direction. The hinges 24 are configured, in particular, as at least 7-joint hinges and each have a mechanism 35 (FIG. 8) by which during the pivot movement of this door 4, 4*a*, this central rotation axis A of the door 4, 4*a* is automatically displaced in the width direction and thus in the x-direction of the domestic refrigeration appliance 1. This means that, during its pivot movement, the door 4, 4*a* undergoes not only such a rotary movement, but simultaneously also a linear displacement movement outwardly in the width direction. This means that the door 4, 4*a* is then displaced to a certain extent beside the housing 2.

Figure 8:
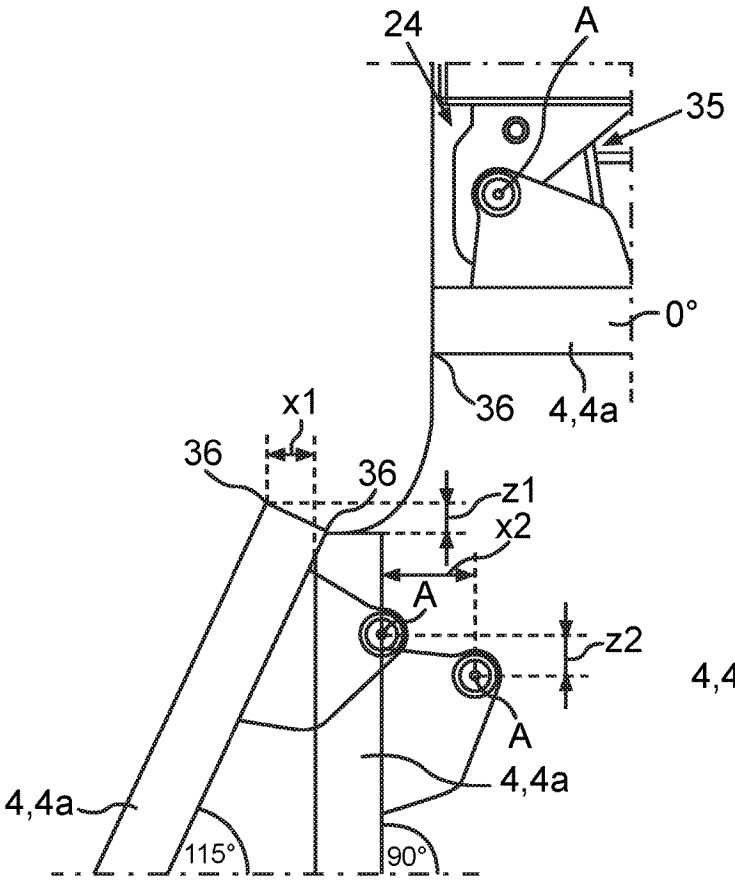
FIG. 8 is an enlarged representation of a partial portion of FIG. 7.

For this purpose, it is provided, in particular, that the mechanism 35 is configured such that the displacement of the door 4, 4*a* in the width direction takes place only in a pre-determined angular interval of the overall pivot movement of the door 4, 4*a*. In particular, it is provided that this angular interval is between 85° and 120°, in particular between 90° and 115°, wherein the lower interval limit of this angular interval represents an opening angle of the door 4, 4*a* which is measured starting from the closed position of the door 4, 4*a* as shown in FIG. 8. This also means that particularly on the movement path between the closed position of the door 4, 4*a* to this lower or smaller interval limit, exclusively a rotary movement is carried out and then at this angular interval between 0° and this lower interval limit value, no linear displacement in the width direction takes place. Furthermore, it is also provided that the hinges 24 with their mechanism 35 are configured so that the door 4, 4*a* also carries out a linear movement in the depth direction, wherein this takes place such that the door 4, 4*a* is linearly displaced during its pivot movement toward the housing in this depth direction. In particular it is provided that the door 4, 4*a* is displaced in the width direction (x-direction) in relation to a corner region 36 by a value x1 (FIG. 9). In particular it is also provided that the door 4, 4*a* is displaced during its pivot movement in the depth direction (z-direction) of the domestic refrigeration appliance 1 in relation to the corner region 36 by a value z1 (FIG. 9) in the direction of the housing 2. In relation to a rotation axis A of the door 4, 4*a*, this rotation axis A is displaced by a value x2 in the width direction and by a value z2 in the depth direction. The values x1 and x2 can be the same or different and/or the values z1 and z2 can be the same or different.

In FIG. 8, in this regard, an enlarged representation is shown in which the four positions of the door 4, 4*a* at 0°, 90° and 115° are illustrated. As shown, for example, at the rear outer corner region 36 of the door 4, 4*a*, it moves outwardly, for example, along a displacement path with the value x1 in the width direction and thus away from the housing 2. In the depth direction, this corner region 36 moves along a displacement path with the value z1 rearwardly and thus in the direction of the housing 2, wherein this setting of the two paths is begun, in particular, only after reaching an opening angle of the door 4, 4*a*, in particular from 85°, preferably from 90° and in particular until the angle of 115° is reached or completed. Similar applies to the routes with the values x2 and z2.

In all the exemplary embodiments, it can also be provided that a pedestal 37 is also present (FIGS. 1, 2). The housing 2 can be placed on this pedestal 37, so that the functioning as a built-in appliance is further improved. By means of the pedestal 37, the adaptation to existing situations in the furniture wall can be achieved and thus the individual height position of the domestic refrigeration appliance 1 in this furniture wall can be adapted. It can be provided that the domestic refrigeration appliance has an adjusting device with which the pedestal 37 is adjustable in the depth direction of the domestic refrigeration appliance 1.

The mechanism 35 of the multiple-joint hinge contains, in particular, seven separate joint arms which are joined to one another in articulated manner so that the hinge 24 has seven rotation points. The rotation axis A in question can relate in this regard to a central axis of the hinge 24 or can additionally or alternatively relate to a specific point of the door 4, 4*a*, for example, the corner point 36, wherein here also other points of the door 4, 4*a* can be used as reference points for this position change. By means of the hinge 24, therefore, not only a pivot movement alone, but also a pivot-displacement movement or a rotation-linear movement can be predetermined as a coupled movement for the movement sequence of the door 4, 4*a*.

The following is a summary list of reference numerals and the corresponding structure used in the above description of the invention:

1 Domestic refrigeration appliance
2 Housing
3 Cooling compartment
4 Door
4*a* Door
4*b* Door
5 Freezing compartment
6 Door
7 Additional part
7*a* Additional part
8 Hole
9 Niche
10 Dispensing unit
11 Furniture front panel
12 Ice maker
13 Receptacle container
14 Internal container
15 Output unit
16 Lower region
17 Machine space
18 Water-conducting assembly
19 Valve
20 Conduit
21 Valve
22 Conduit
23 Conduit
24 Hinge
25 Rear side
26 Lower edge
27 Receptacle
28 Thermal insulating material
29 Adjusting device
30 Adjusting element
31 Rear back wall region
32 Housing
33 Niche

34 Back wall region
35 Mechanism
36 Corner region
37 Pedestal
41*a* Front side
41*b* Front side
A Rotation axis
α Angle

The invention claimed is:

1. A domestic refrigeration appliance, comprising:

a housing defining a cooling compartment;

a first door movably disposed on said housing for closing off said cooling compartment;

a dispensing unit having an output unit and an ice maker, and configured for outputting of liquid and/or molded ice elements, said dispensing unit disposed on said first door, at least one multiple-joint hinge;

said first door having a rear side facing toward said cooling compartment and a receptacle protruding toward said cooling compartment, in said receptacle said dispensing unit is disposed, said first door being pivotably disposed via said at least one multiple-joint hinge on said housing; and said at least one multiple-joint hinge having a mechanism with which, during a pivoting movement of said first door, said first door is also displaced in a width direction.

2. The domestic refrigeration appliance according to claim 1, wherein said mechanism is configured such that a linear displacement component of a rotation-linear overall movement of said first door takes place in the width direction only in a pre-determined angular interval of the pivoting movement of said first door.

3. The domestic refrigeration appliance according to claim 2, wherein the predetermined angular interval is between 85° and 120° starting from a closed position of said first door.

4. The domestic refrigeration appliance according to claim 2, wherein the predetermined angular interval is between 90° and 115° starting from a closed position of said first door.

5. The domestic refrigeration appliance according to claim 1, wherein said mechanism is configured such that said first door is displaced in the width direction and in a depth direction of the domestic refrigeration appliance, with a respective linear displacement component of a rotation-linear overall movement.

6. The domestic refrigeration appliance according to claim 1, further comprising a first panel-shaped additional part being separate from said first door and disposed on a front side of said first door, said first panel-shaped additional part is disposed as a facing part and having a hole formed therein, through said hole said output unit of said dispensing unit belonging to the domestic refrigeration appliance which is configured for an output of the liquid and/or the molded ice elements is accessible.

7. The domestic refrigeration appliance according to claim 6, further comprising an adjusting device with which at least said output unit of said dispensing unit is adjustable in at least two spatial directions relative to at least one of said first door or said first panel-shaped additional part disposed separately on said front side of said first door.

8. The domestic refrigeration appliance according to claim 7, wherein:

said output unit has an output housing with a rear back wall region and a further back wall region with a niche formed therein; and said adjusting device has at least one displaceable adjusting element which is asymmetrical in shape and which is disposed in said niche offset forwardly in a depth direction of the domestic refrigeration appliance relative to said rear back wall region of said output housing of said output unit, said niche being delimited by said further back wall region of said output housing disposed further forward.

9. The domestic refrigeration appliance according to claim 8, wherein said adjusting element is a wedge.

10. The domestic refrigeration appliance according to claim 6, further comprising a water-conducting assembly with which water is conductable to said dispensing unit, wherein said water-conducting assembly has at least one valve disposed on said first door, said valve is disposed at a lower edge of said first door and is hidden at said front side by means of said first panel-shaped additional part on said first door.

11. The domestic refrigeration appliance according to claim 6, wherein said first panel-shaped additional part is a furniture front panel.

12. The domestic refrigeration appliance according to claim 1, further comprising:

a freezing compartment being separate from said cooling compartment; and a second door for closing off said freezing compartment and movably disposed on said housing, said second door is disposed in a plane in which said first and second doors extend, without overlap beside said first door.

13. The domestic refrigeration appliance according to claim 12, further comprising a second panel shaped additional part disposed on a front side of said second door.

14. The domestic refrigeration appliance according to claim 13, wherein said second panel shaped additional part is a furniture front panel.

15. The domestic refrigeration appliance according to claim 1, further comprising a third door, said cooling compartment is closable by said first door and by said third door, said third door disposed seen in the width direction of the domestic refrigeration appliance, beside said first door.

16. The domestic refrigeration appliance according to claim 1, wherein the domestic refrigeration appliance is a built-in appliance for installation in an installation niche of a furniture wall.

17. The domestic refrigeration appliance according to claim 1, further comprising a machine space separated from said cooling compartment, a water supply conduit provided in said machine compartment, said water supply conduit laid from said machine space to said door via said multiple joint hinge.

18. The domestic refrigeration appliance according to claim 17, further comprising valves disposed on said door, said water supply conduit being fluidically connected to said valves.

* * * * *